US006206099B1

(12) United States Patent
Olivera

(10) Patent No.: US 6,206,099 B1
(45) Date of Patent: Mar. 27, 2001

(54) METHOD FOR RELATING MULTIPLE OIL OR GAS WELLS TO EACH OTHER

(76) Inventor: Fernando Olivera, Becerra #1A, Esquina Heredia, Colonia Pensiones, Villahermosa, Tabasco (MX)

( * ) Notice: Subject to any disclaimer, the term of this patent is extended or adjusted under 35 U.S.C. 154(b) by 0 days.

(21) Appl. No.: 09/487,280

(22) Filed: Jan. 19, 2000

(51) Int. Cl.[7] ..... E21B 47/00
(52) U.S. Cl. ..... 166/245; 166/250.16; 73/152.01
(58) Field of Search ..... 166/245, 250.16, 166/52, 250.01; 73/152.01

(56) References Cited

U.S. PATENT DOCUMENTS

| | | | | |
|---|---|---|---|---|
| 1,872,906 | * | 8/1932 | Doherty | 166/52 |
| 3,093,190 | * | 6/1963 | Hoyt | 166/245 |
| 3,524,346 | * | 8/1970 | Schmidt | 166/250.1 |
| 3,921,126 | * | 11/1975 | Waters | 166/250.1 |
| 5,388,456 | * | 2/1995 | Kettel | 73/152.02 |

OTHER PUBLICATIONS

Brochure, "ResGram Spatial Data Analysis", Author and Date unknown.
Brochure, "Wbgeos–Geostatistics for the Reservoir Engineer and Geoscientist", Scientific Software—Intercomp, 1994.
Brochure, No Title, The Andrews Group International, 1997 and including 2 sheets regarding Semi–Variogram program.

* cited by examiner

*Primary Examiner*—Hoang Dang
(74) *Attorney, Agent, or Firm*—Holland & Knight LLP

(57) ABSTRACT

A method of relating three or four producing wells in an existing fossil fuel drilling field utilizes the equation $Y^2+X\cdot Y-X^2=0$. The independent variable X represents the distance between any two known producing wells in the field. The dependant variable Y represents a distance between a known producing well and another well location, wherein each of the known producing wells and well locations depend upon which method utilized. In one method, a first origin well can be selected as a known producing well and then a distance from the origin well to a second producing well can be determined. Utilizing the above equation, a third well location can be determined by calculating a distance Y from the origin well to the third location. This well location can represent either an existing producing well located a distance from the origin well, or a new location at which a producing well can be drilled within the existing drilling field. In another method, the distance X represents a distance between a first and a second known producing well. A third producing well is then selected within the existing field. The equation is then utilized to calculate a distance Y from the third producing well to a fourth well location. The fourth well location is either a location of an existing producing well in the field, or a location for drilling a new producing well in the field.

12 Claims, 23 Drawing Sheets

FIG. 9

THE OSEBERG FIELD IN THE VIKING BASIN OF NORWAY

| DATA # | WELLS PAIR | X DISTANCES | WELLS PAIR | Y DISTANCES |
|---|---|---|---|---|
| 1 | □03-□0912 | 17095.86 | □01-□0901 | 10575.76 |
| 2 | □17-□0912 | 16563.34 | □01-□0902 | 5813.077 |
| 3 | □17-□0912 | 16563.34 | □01-□21 | 10229.76 |
| 4 | □C01-□0902 | 16146.62 | □12-□0902 | 9980.013 |
| 5 | □06-□0901 | 15637.63 | □17-□09B01 | 9669.314 |
| 6 | □12-□0912 | 13739.32 | □02-□0902 | 8484.379 |
| 7 | □06-□09B01 | 13225.67 | □07-□017 | 8166.117 |
| 8 | □03-□0901 | 13096.64 | □C01-□C27H | 8097.879 |
| 9 | □03-□0901 | 13096.64 | □17-□21 | 8092.649 |
| 10 | □C01-□09B01 | 13096.53 | □C01-□C27H | 8097.879 |
| 11 | □C01-□09B01 | 13096.53 | □17-□21 | 8092.649 |
| 12 | □12-□14 | 12948.45 | □C27H-□09B01 | 7997.202 |
| 13 | □12-□14 | 12948.45 | □09-□17 | 7992.923 |
| 14 | □02-□0912 | 12612.4 | □06-□09B49 | 7794.509 |
| 15 | □07-□12 | 10616.81 | □06-□21 | 6552.38 |
| 16 | □01-□21 | 10229.76 | □09-012 | 6314.556 |
| 17 | □02-□0901 | 9248.767 | □03-0C27H | 5722.664 |
| 18 | □02-□0901 | 9248.767 | □12-□C27H | 5720.433 |
| 19 | □02-□06 | 9054.166 | □09-□C27H | 5597.858 |
| 20 | □02-□0902 | 8484.379 | □02-□04 | 5243.587 |
| 21 | □10st-□09B49 | 8148.059 | □02-□03 | 5034.264 |
| 22 | □01-□06 | 7101.335 | □04-□0901 | 4383.934 |
| 23 | □0912-□09B01 | 6985.999 | □03-□06 | 4311.281 |
| 24 | □10st-□12 | 6519.746 | □02-□09 | 4031.801 |
| 25 | □06-□07 | 5479.986 | □0901-□0902 | 3392.159 |
| 26 | □06-□07 | 5479.986 | □02-□12 | 3387.389 |
| 27 | □04-□12 | 5184.451 | □06-□10st | 3213.695 |
| 28 | □0902-□09B01 | 3218.047 | □01-□02 | 1991.231 |
| 29 | □06-□10st | 3213.695 | □01-□02 | 1991.231 |

*FIG. 11*

THE OSEBERG FIELD IN THE VIKING BASIN OF NORWAY

| X DISTANCES | Y DISTANCES | Y' DISTANCES | Y-Y'DIFERENCE |
|---|---|---|---|
| 17095.86 | 10575.76 | 10564.15 | 11.61133 |
| 16563.34 | 5813.077 | 10235.16 | 5.203125 |
| 16563.34 | 10229.76 | 10235.16 | -5.397461 |
| 16146.62 | 9980.013 | 9977.707 | 2.305664 |
| 15637.63 | 9669.314 | 9663.252 | 6.0625 |
| 13739.32 | 8484.379 | 8490.473 | -6.09375 |
| 13225.67 | 8166.117 | 8173.139 | -7.021484 |
| 13096.64 | 8097.879 | 8093.424 | 4.455078 |
| 13096.64 | 8092.649 | 8093.424 | -0.7749023 |
| 13096.53 | 8097.879 | 8093.356 | 4.522949 |
| 13096.53 | 8092.649 | 8093.356 | -0.7070313 |
| 12948.45 | 7997.202 | 8001.872 | -4.669922 |
| 12948.45 | 7992.923 | 8001.872 | -8.949219 |
| 12612.4 | 7794.509 | 7794.26 | 0.2490234 |
| 10616.81 | 6552.38 | 6561.38 | -9.000488 |
| 10229.76 | 6314.556 | 6322.261 | -7.694824 |
| 9248.767 | 5722.664 | 5716.201 | 6.462891 |
| 9248.767 | 5720.433 | 5716.201 | 4.231934 |
| 9054.166 | 5597.858 | 55.95.977 | 1.881348 |
| 8484.379 | 5243.587 | 5243.961 | -0.3745117 |
| 8148.059 | 5034.264 | 5036.183 | -1.918457 |
| 7101.335 | 4383.934 | 4389.515 | -5.580566 |
| 6985.999 | 4311.281 | 4318.26 | -6.979004 |
| 6519.746 | 4031.801 | 430.208 | 1.593018 |
| 5479.986 | 3392.159 | 3387.842 | 4.31665 |

FIG. 15

THE CAPTAIN FIELD IN THE MORAY OFFSHORE BASIN OF THE UNITED KINGDOM

| DATA # | WELLS PAIR | X DISTANCES | WELLS PAIR | Y DISTANCES |
|---|---|---|---|---|
| 1 | C08-C15 | 6454.585 | C06-C15 | 3991.864 |
| 2 | C16-C17 | 6122.529 | C05-C09A | 3780.627 |
| 3 | C11st-C12s | 4899.439 | C01-C03 | 3029.759 |
| 4 | C10-C15 | 4845.862 | C06-C11st | 2997.25 |
| 5 | C03-C15 | 4192.595 | C07-C16 | 2596.091 |
| 6 | C06-C14 | 4037.261 | C09A-C12s | 2493.615 |
| 7 | C06-C14 | 4037.261 | C09A-C12s | 2490.465 |
| 8 | C06-C13 | 4036.438 | C09A-C12s | 2493.615 |
| 9 | C06-C13 | 4036.438 | C09A-C17 | 2490.465 |
| 10 | C06-C13 | 4036.438 | C09A-C11st | 2489.985 |
| 11 | C09A-C16 | 4025.995 | C09A-C17 | 2490.465 |
| 12 | C09A-C16 | 4025.995 | C09A-C11st | 2489.985 |
| 13 | C09A-C16 | 4025.995 | C06-C12s | 2487.081 |
| 14 | C06-C15 | 3991.864 | C01-C10 | 2469.635 |
| 15 | C10-C17 | 3715.292 | C06-C07 | 2299.804 |
| 16 | C10-C17 | 3715.292 | C02-C10 | 2295.783 |
| 17 | C10-C16 | 3513.501 | C03-C13 | 2172.584 |
| 18 | C06-C17 | 3488.957 | C15-C17 | 2152.788 |
| 19 | C06-C11st | 2997.25 | C08-C10 | 1851.004 |
| 20 | C10-C13 | 2782 | C12s-C14 | 1723.909 |
| 21 | C03-C11st | 2747.604 | C03-C09A | 1699.916 |
| 22 | C01-C14 | 2729.472 | C02-C12s | 1687.035 |
| 23 | C03-C13 | 2172.584 | C10-C12s | 1342.856 |
| 24 | C05-C12s | 2009.895 | C02-C16 | 1240.101 |
| 25 | C08-C10 | 1851.004 | C01-C13 | 1146.563 |
| 26 | C12s-C14 | 1723.909 | C02-C05 | 1060.552 |
| 27 | C01-C07 | 1549.059 | C07-C08 | 959.0715 |

FIG. 17

THE CAPTAIN FIELD IN THE MORAY BASIN OF UNITED KINGDOM

| X DISTANCES | Y DISTANCES | Y' DISTANCES | Y-Y'DISTANCES |
|---|---|---|---|
| 6454.585 | 3991.864 | 3989.43 | 2.434326 |
| 6122.529 | 3780.627 | 3784.18 | -3.552979 |
| 4899.439 | 3029.759 | 3028.167 | 1.592529 |
| 4845.862 | 2997.25 | 2995.05 | 2.200439 |
| 4192.595 | 2596.091 | 2591.254 | 4.837158 |
| 4037.261 | 2493.615 | 2495.239 | -1.624268 |
| 4037.261 | 2490.465 | 2495.239 | -4.77417 |
| 4036.438 | 2493.615 | 2494.73 | -1.115479 |
| 4036.438 | 2490.465 | 2494.73 | -4.265381 |
| 4036.438 | 2489.985 | 2494.73 | -4.745361 |
| 4025.995 | 2490.465 | 2488.276 | 2.189453 |
| 4025.995 | 2489.985 | 2488.276 | 1.709473 |
| 4025.995 | 2487.081 | 2488.276 | -1.19458 |
| 3991.864 | 2469.635 | 2467.178 | 2.456543 |
| 3715.292 | 2299.804 | 2296.224 | 3.57959 |
| 3715.292 | 2295.783 | 2296.224 | -0.4414063 |
| 3513.501 | 2172.584 | 2171.494 | 1.090088 |
| 3488.957 | 2152.788 | 2156.323 | -3.534668 |
| 2997.25 | 1851.004 | 1852.39 | -1.385986 |
| 2782 | 1723.909 | 1719.34 | 4.568848 |
| 2747.604 | 1699.916 | 1698.079 | 1.836548 |
| 2729.472 | 1687.035 | 1686.872 | 0.163301 |
| 2172.584 | 1342.856 | 1342.649 | 0.206543 |
| 2009.895 | 1240.101 | 1242.089 | -1.987549 |
| 1851.004 | 1146.563 | 1143.875 | 2.687744 |
| 1723.909 | 1060.552 | 1065.316 | -4.76355 |
| 1549.059 | 959.0715 | 957.2376 | 1.833862 |

*FIG. 20*

THE IZOZOG FIELD IN THE TARIJA BASIN OF ARGENTINA-BOLIVIA

| DATA # | WELLS PAIR | X DISTANCES | WELLS PAIR | Y DISTANCES |
|---|---|---|---|---|
| 1 | IZ4-IZ12 | 49466.57 | IZ8-IZ12 | 42937.67 |
| 2 | IZ6-IZ9 | 61657.9 | IZ6-IZ7 | 38135.56 |
| 3 | IZ3-IZ5 | 56172.48 | IZ1-IZ6 | 34723.59 |
| 4 | IZ2-IZ9 | 46442.02 | IZ2-IZ12 | 28702.02 |
| 5 | IZ2-IZ8 | 37324.62 | IZ6-IZ10 | 23111.01 |
| 6 | IZ3-IZ7 | 35730.16 | IZ3-IZ8 | 22115.69 |
| 7 | IZ1-IZ3 | 22812.23 | IZA-IZ6 | 14142.98 |
| 8 | IZ2-IZ7 | 22115.69 | IZ3-IZ7 | 13626.13 |
| 9 | IZ2-IZ11 | 11157.18 | IZ3-IZ11 | 6861.518 |

*FIG. 22*

STATISTICAL CALCULATIONS

THE IZOZOG FIELD IN THE TARIJA BASIN OF ARGENTINA-BOLIVIA

| X DISTANCES | Y DISTANCES | Y' DISTANCES | Y-Y'DISTANCES |
|---|---|---|---|
| 49466.57 | 42937.67 | 42956.81 | -19.13672 |
| 61657.9 | 38135.56 | 38126.85 | 8.710938 |
| 56172.48 | 34723.59 | 34733.91 | -10.31641 |
| 46442.02 | 28702.02 | 28715.25 | -13.22656 |
| 37324.62 | 23111.01 | 23075.79 | 35.22266 |
| 35730.16 | 22115.69 | 22089.55 | 26.13867 |
| 22812.23 | 14142.98 | 14099.32 | 43.66211 |
| 22115.69 | 13626.13 | 13668.48 | -42.35156 |
| 11157.18 | 6861.518 | 6890.224 | -28.70605 |

*FIG. 23*

| COUNTRY | No. OF WELLS | OIL FIELD | DISTANCE PAIRS | CONSTANT OR SLOPE B |
|---|---|---|---|---|
| NORWAY | 19 | OSEBERG | 29 | 0.6178017 |
| NORWAY | 26 | GULLFAKS | 106 | 0.6181161 |
| NORWAY | 28 | TROLL | 65 | 0.6181058 |
| UNITED KINGDOM | 16 | CAPTAIN | 27 | 0.6181176 |
| BRAZIL | 25 | ALBACORA | 126 | 0.6180876 |
| BRAZIL | 24 | MARLIN | 68 | 0.6179149 |
| ARGENTINA | 12 | IZOZOG | 9 | 0.6185382 |
| ARGENTINA | 37 | TSX,P | 37 | 0.6179236 |
| MEXICO | 31 | CASTARRICAL | 187 | 0.6178003 |
| MEXICO | 38 | MECOACAN | 226 | 0.6178003 |
| AVERAGE = 0.61804 | | | | |

METHOD FOR RELATING MULTIPLE OIL OR GAS WELLS TO EACH OTHER

BACKGROUND OF THE INVENTION

1. Field of the Invention

The present invention is generally related to fossil fuel producing well fields, and more particularly to a system and method of mathematically relating two or three producing wells in the field either to locate another existing producing well or to locate a position that will yield another producing well.

2. Description of the Related Art

Presently, there are many oil or natural gas producing fields located around the world. Each of these fields includes a number of producing wells that generate a fossil fuel such as oil or natural gas. The wells are distributed over the area of a given field in what appears to be a haphazard manner.

Each well position is originally located and selected for drilling by searching for oil and natural gas utilizing a number of different methods. One method is to simply look for ground seepage wherein oil or natural gas escapes from the earth through the ground into the atmosphere. Oil seepage can be located by visual inspection. Gas seepage can be traced by sensitive equipment that measures the presence or absence of natural gas in the atmosphere. These methods are known as surface methods. Another method is known as either gravity or magnetic survey wherein small changes in the electromagnetic field or gravitational force of the earth at a given area are measured relative to the surrounding areas. These small changes indicate underground formations that may be conducive to oil or natural gas reservoirs. A third method is commonly known as seismographic exploration that can be utilized to detect smaller and less obvious rock formations and underground traps that can include reservoirs of oil or natural gas that are otherwise not discoverable by the previous less sophisticated methods. Seismic surveying utilizes sound transmitted through the ground to indicate less obvious underground formations that can be conducive to oil or natural gas reservoirs. This procedure is repeated over wide areas to determine the possible locations of pockets or reservoirs of oil and/or natural gas.

Heretofore, there has been no method known to somehow relate each and every oil well that exists in an oil field. There is further no presently known method of relating all existing oil wells in a given field for determining prime locations to drill additional oil wells in the field without resorting to the sophisticated, costly and time consuming methods of locating new well sites

SUMMARY OF THE INVENTION

The present invention for a method to mathematically relate each and every producing well in a given oil field. One object of the present invention is to provide a method of relating each and every oil producing well in a given field without resorting to more sophisticated and time consuming methods of locating one or more producing wells. Another object of the present invention is to provide a method of relating all of the oil producing wells in a given field in a manner that will yield other possible locations for new producing wells within the given field.

To accomplish these and other objects, features and advantages of the present invention, a method of relating producing wells in a given fossil fuel drilling field is provided. In one embodiment, the method includes selecting a first origin well known to be a producing well. Next, a second well is selected that is also known to be a producing well. A distance X is then determined between the first origin well and the second well. A distance Y is then calculated from the first origin well to a third well location and using the equation $$Y^2+X\cdot Y-X^2=0$$

Next, the third well location is selected relative to the first origin well and having the distance Y from the first well.

In one embodiment, the fossil fuel produced by the existing drilling field is a petroleum oil product. In another embodiment, the fossil fuel is a natural gas product.

In one embodiment, the distance between the first origin well and the second well is calculated using Universal Transverse Mercator coordinates.

In one embodiment, the third well location is calculated in order to locate an existing well known to be a producing well.

In another embodiment, the third well location is determined in order to locate an area for drilling a new producing well.

In another embodiment of the present invention, a method of relating producing wells in a given fossil fuel drilling field is provided. In this embodiment, the method includes selecting a first and a second well each of which are known to be producing wells. An origin distance X is then determined between the first well and the second well. A third well also known to be a producing well is then selected. A distance Y is then calculated from the third well to a fourth well location and using the equation $$Y^2+X\cdot Y-X^2=0$$

Next, the fourth well location is selected relative to the third well and having a distance Y from the third well.

In one embodiment, the fourth well location is a known existing location of a producing well in the fossil fuel drilling field. In another embodiment, the fourth well location is determined for locating an area in which to drill a new producing well in the existing field.

These and other objects, features and advantages of the present invention will become apparent upon a review of the written description and accompanying drawings.

BRIEF DESCRIPTION OF THE DRAWINGS

The following drawing figures illustrates aspects of the present invention wherein:

FIG. 9 illustrates a data table indicating each pairing of distances between producing wells that yields the mathematical constant and wherein each of the producing wells is included;

FIG. 11 illustrates a chart comparing the actual distances between producing wells of the table of FIG. 9 to the average of all the data of the table;

FIG. 15 illustrates a table including data for each well pairing that yields a constant mathematical relationship and wherein each well of the entire field is utilized;

FIG. 17 illustrates a table comparing the actual distances of wells from the table of FIG. 15 and the average of all data in the table of FIG. 15;

FIG. 20 illustrates a table showing the pairs of distances for the field illustrated in FIG. 18 that yield a constant mathematical relationship and that utilizes all of the producing wells of the field;

FIG. 22 illustrates a table providing the data comparing the actual measured distance relationships and the average relationships utilizing all the data of the table of FIG. 20; and FIG. 23 illustrates a table showing the results of analyzing ten different oil fields.

DETAILED DESCRIPTION OF THE PREFERRED EMBODIMENTS

Figure 1:
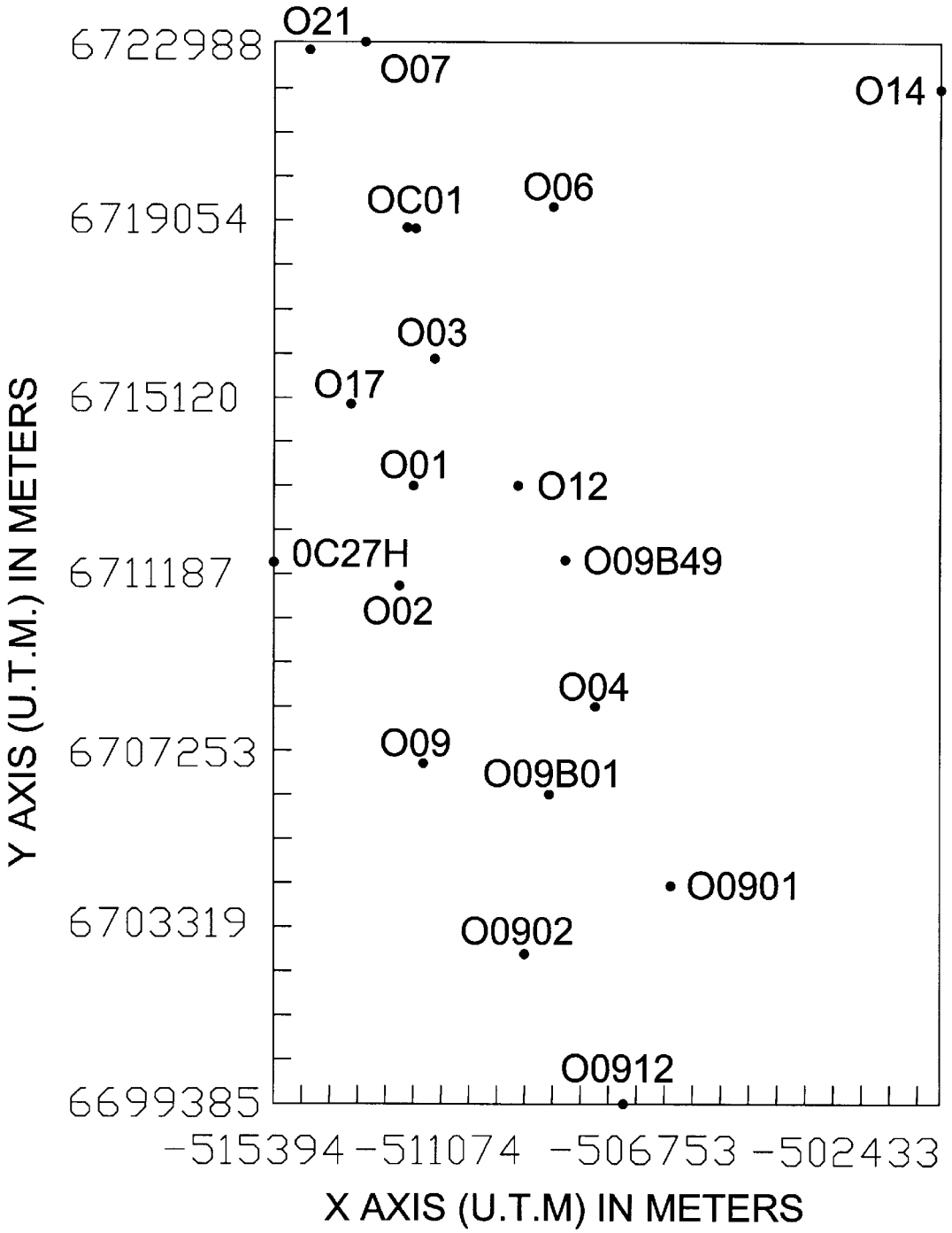
FIG. 1 illustrates a schematic drawing of an oil producing field located in Norway and including nineteen producing wells.

Referring now to the drawings, FIG. 1 illustrates a schematic chart showing the geographic location of each producing well in a productive oil field known as the Oseberg field in Norway. The units of the x-axis and the y-axis of the chart are each in metric meters. The intersection of the x-axis and y-axis for the chart is not zero but instead is the southernmost and westernmost location of producing wells in the entire field. The chart represents a coordinate system known as the Universal Transverse Mercator (UTM) geographical coordinate system and is based on data of 1927. In this system, there is one horizontal and vertical 0 coordinate and then every geographic location is taken from the 0 coordinate and measured in meters both horizontally and vertically relative to the origin. Therefore, the horizontal or x-axis of the chart represents the distance in meters along a horizontal axis from the 0 coordinate of the UTM coordinate system. Similarly, the vertical or y-axis represents the distance in meters relative to the 0 coordinate along a vertical axis of the UTM coordinate system.

Figure 2:
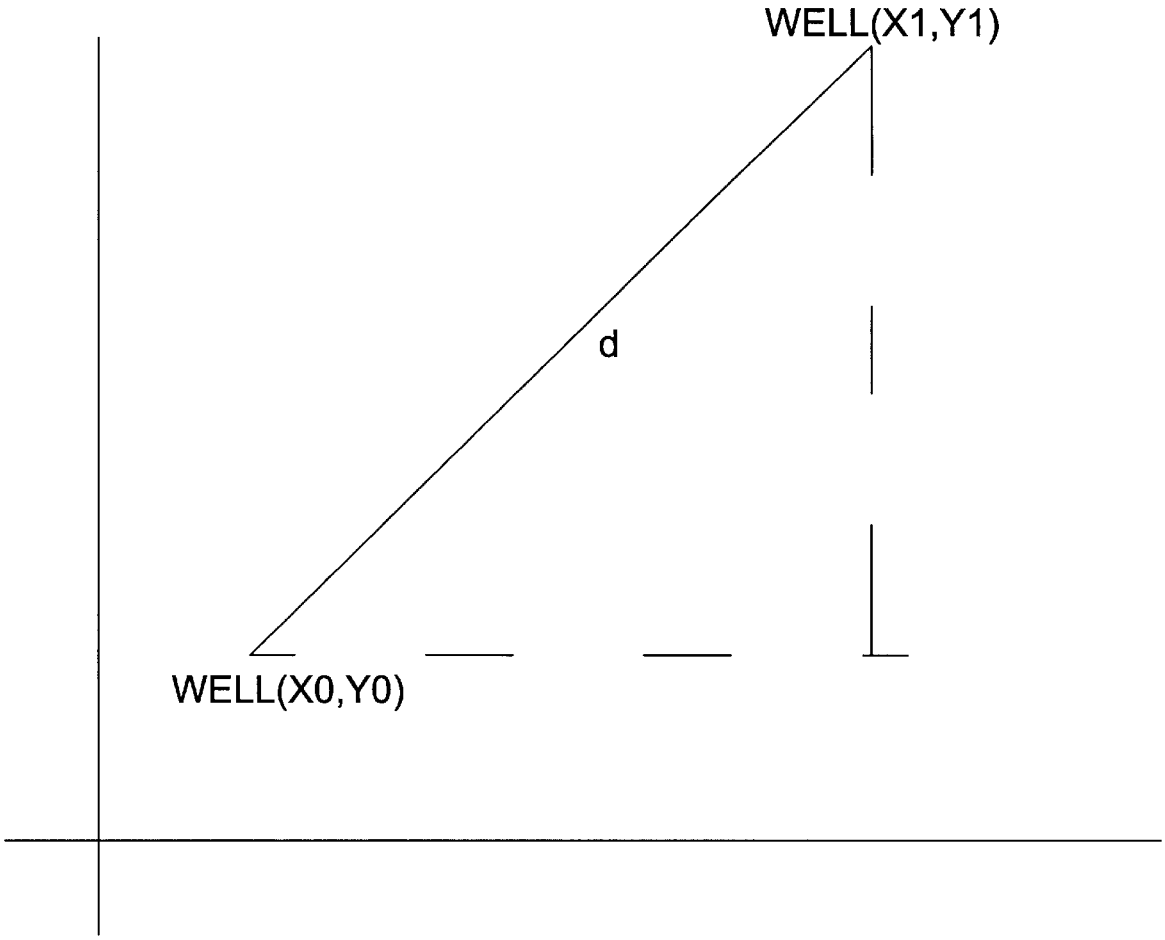
FIG. 2 illustrates a graph illustrating x-axis and y-axis distance coordinates between two producing wells of the field.

FIG. 2 illustrates a simple schematic showing how, utilizing the UTM coordinate system, an actual distance in meters between two producing wells is calculated for the purposes of this invention. The lower left well identified by the coordinates (X0, Y0) is located spaced from a second well identified having the coordinates (X1, Y1). Utilizing the commonly known equation $$d=\sqrt{(X_1-X_0)^2+(Y_1-Y_0)^2} \quad \text{(EQ. 1)}$$

This equation calculates the hyphothonus of a right triangle indicated by the dotted lines in FIG. 2. The horizontal dotted line represents the distance along the x- axis between the two wells and the vertical dotted line represents the distance along the y-axis between the wells. Utilizing the equation, the distance d between the two wells can be calculated as long as the coordinates in the UTM coordinate system are known for each producing well.

The present invention provides a method for relating all of the producing wells in any given oil field wherein a mathematical relationship can be utilized for a number of different purposes. The relationship between each of the producing wells in a particular oil field is dependent upon the distances between all of the wells. By analyzing each of the distances between given pairs of producing wells in a number of different manners, a reoccurring relationship is discovered that relates all oil producing wells in a given field. An example is presented thoroughly explaining the inventive method and then the mathematical relationship that is realized is discussed. Two more examples are also presented and discussed in less detail herein.

Figure 3:
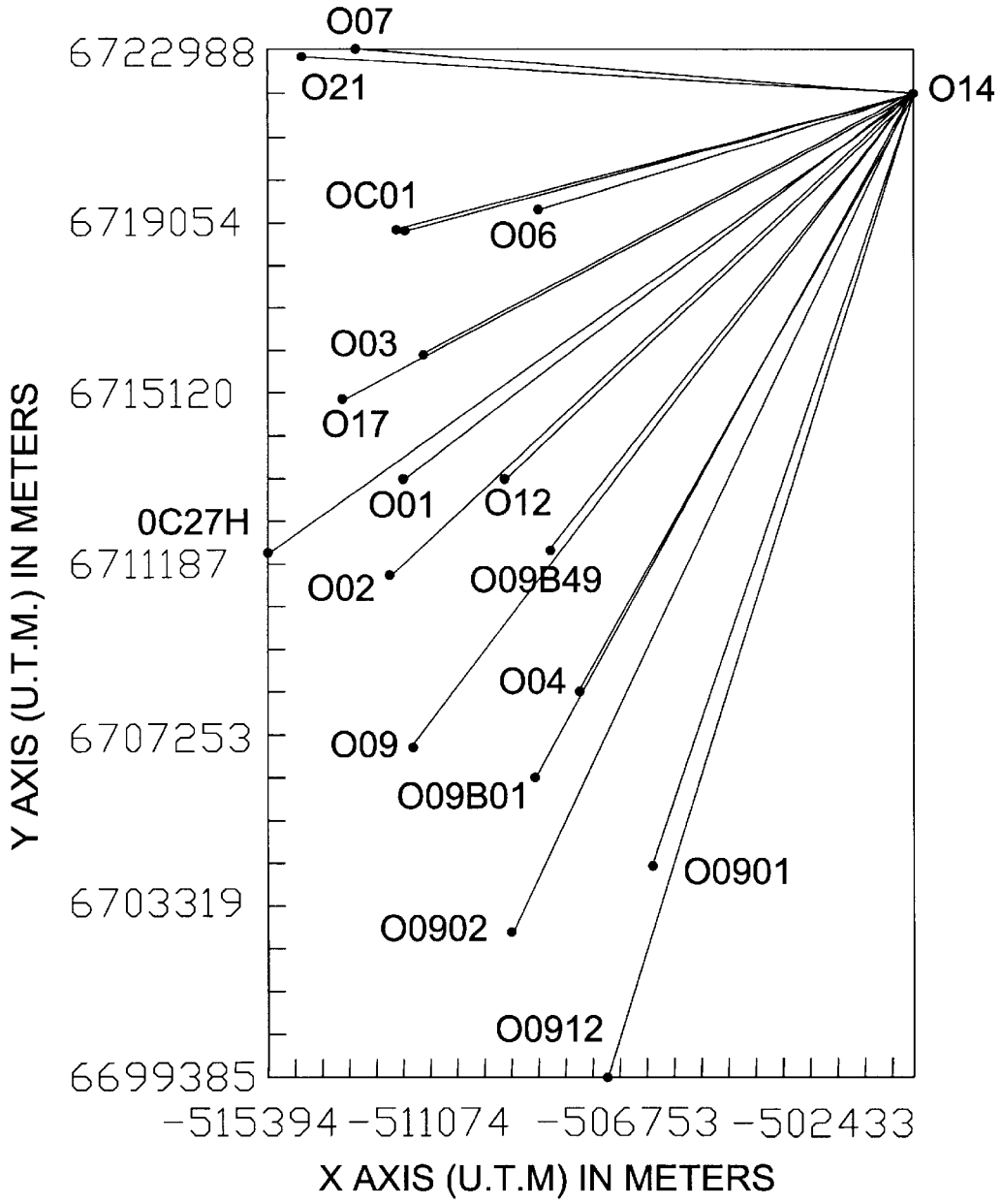
FIG. 3 illustrates the chart of FIG. 1 with lines drawn from one origin well to each of the remaining wells of the field.
Figure 4:
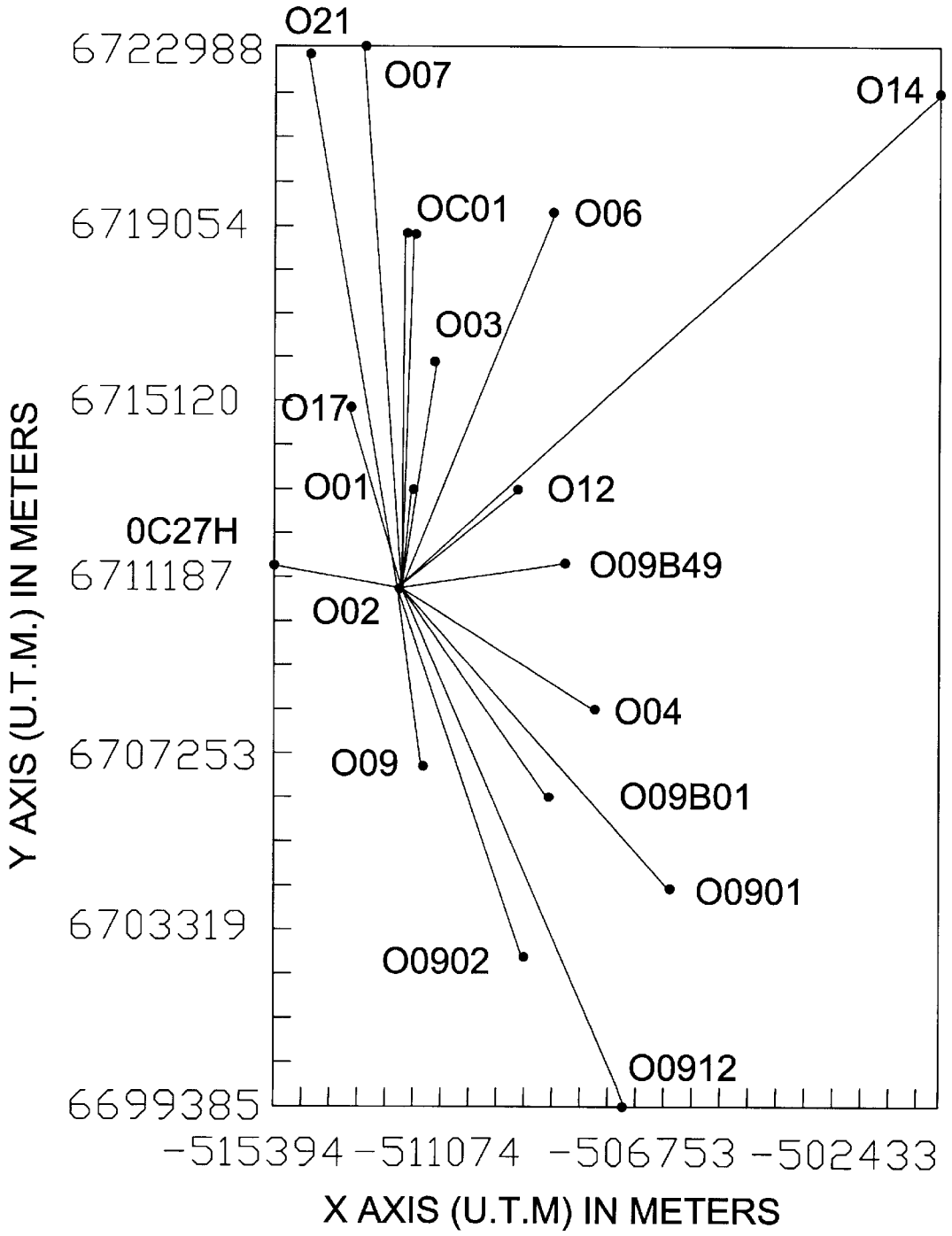
FIG. 4 illustrates a chart showing a different well selected as the origin well and lines drawn from this origin well to each remaining well of the field.

A first statistical analysis was conducted. Referring to FIG. 3, a chart representing each of the producing wells in the Oseberg field is illustrated wherein one of the wells identified as well O14 is selected as the origin well and a distance from the origin well to each other producing well of the field is calculated utilizing the equation 1 noted above. FIG. 4 illustrates the chart showing each of the wells of the Oseberg field except wherein the well O02 is selected as the origin well. The distance from the origin well to each of the remaining producing wells of the field is then calculated and also includes the distance from the origin well O02 to the previously selected origin well O14. This was done for each well selected as the origin well.

Figure 5:
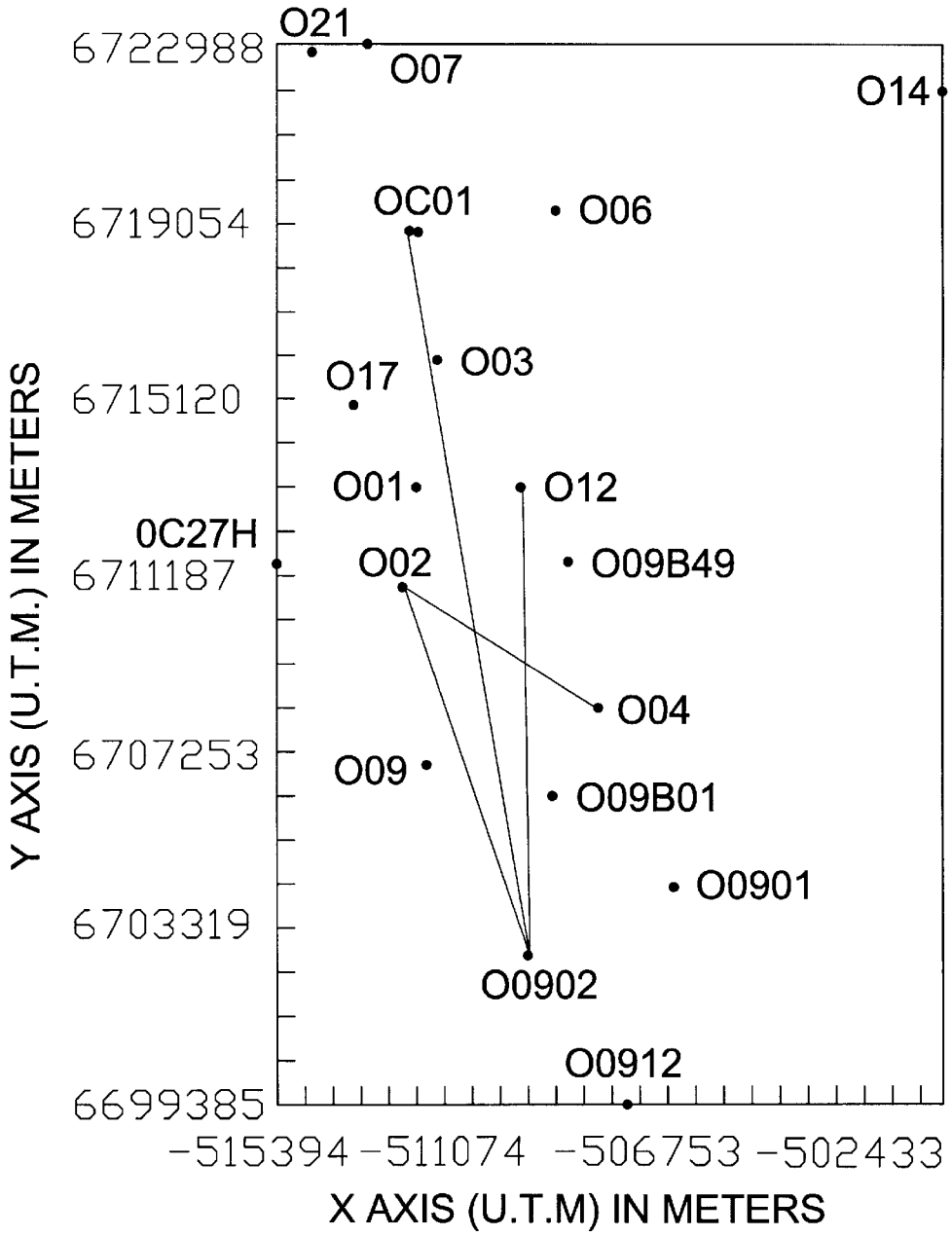
FIG. 5 illustrates a chart showing the distance between one selected pair of wells, one being an origin well, in comparison to the distance between a third selected producing well from the origin well, and showing another distance between two producing wells, one being another origin well, compared to the distance between another third selected producing well and its origin well.

Couples or pairs of distances having a common origin well were then compared for each producing well selected as the origin well. For example, as illustrated in FIG. 5, an origin well is O02 and one couple or pair of distances is illustrated including the distance from O02 to the well O04 and the distance from O02 to the well O0902. FIG. 5 also illustrates the producing well O0902 selected as the origin well and illustrates one couple or pair of distances. One distance is from O0902 to the well O12 and another distance is from O0902 to the well OC01. Therefore, for each well selected as the origin well in the Oseberg field, which includes nineteen total producing wells, there are eighteen distances between each origin well and the remaining producing wells in the field. Though these distances are repeated a number of times, there are a total of 19×18=342 total distances possible for all wells selected as the origin well. For each well selected as the origin well, there are seventeen possible couples or pairs of distances from the origin well to two selected of the remaining producing wells. Therefore, there are 19×17=323 total possible couples or pairs of distances without repeating any pairs or couples of distances and without repeating the origin well. The ratio of the smaller distance over the larger distance for every possible pair or couple of distances in the entire oil field of Oseberg was then analyzed and compared.

Figure 6:
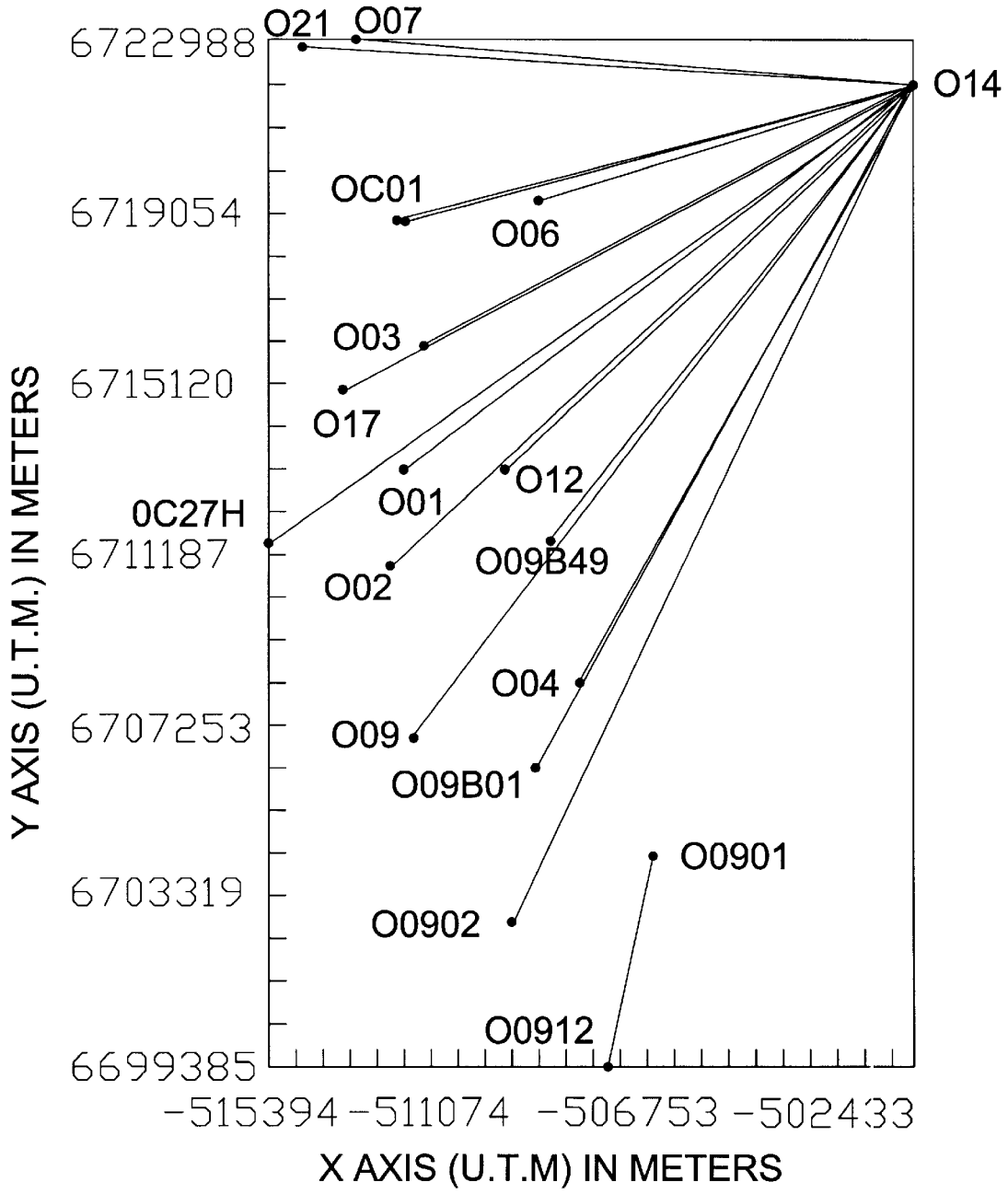
FIG. 6 illustrates a chart showing the distance between a pair of selected producing wells and the distance between a third selected producing well and each remaining producing well.

A second statistical analysis was also conducted on the distance data for the producing wells of the Oseberg field. In the first statistical analysis noted above in FIG. 5, for comparing couples of distances having a common origin well, three producing wells were required. Referring to FIG. 6, the second statistical analysis was conducted selecting four producing wells at any one time. One distance is first selected as the origin distance. For example, the distance between the producing well O0912 and O0901, was selected as the origin distance and is shown in FIG. 6. A third well such as the well O14 is next selected. The distance between the third well and each remaining unselected well is then calculated as is also illustrated in FIG. 6. Each of these distances is then separately compared to the origin distance to form separate pairs or couples of distances utilizing four producing wells. In this manner, each distance is separately selected as the origin distance between two given producing wells and compared to each other distance between any two of the remaining producing wells. An exhaustive analysis of each possible distance coupling or pairing utilizing four wells at a time was then studied without repeating distance pairings or couplings.

Figure 7:
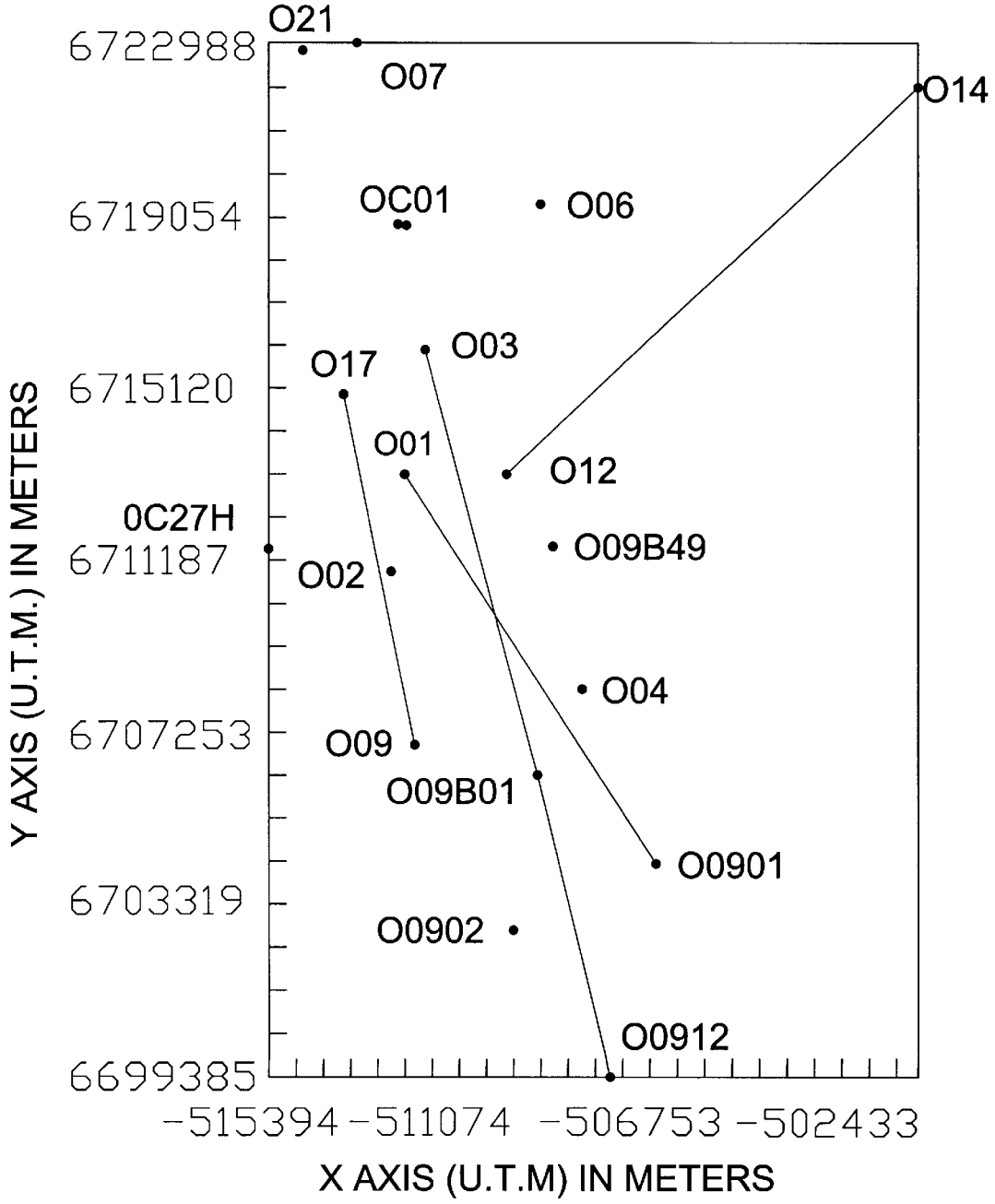
FIG. 7 illustrates a chart showing the distances between four selected pairs of producing wells.

As illustrated in FIG. 7, two examples of distance pairings or couplings are illustrated utilizing four separate wells for each pairing or coupling. For example, one origin distance is selected as the distance between the producing well O14 and the producing well O12. The coupled or paired distance was the distance between the producing well O17 and the producing well O09. A second exemplary pairing or coupling is the origin distance between the well O13 and the well O0912 and the coupled distance between the well O01 and well O0901. The ratio of each possible distance pairing or coupling utilizing four wells was then determined whereby the smaller distance of each pairing is divided by the larger distance.

Figure 8:
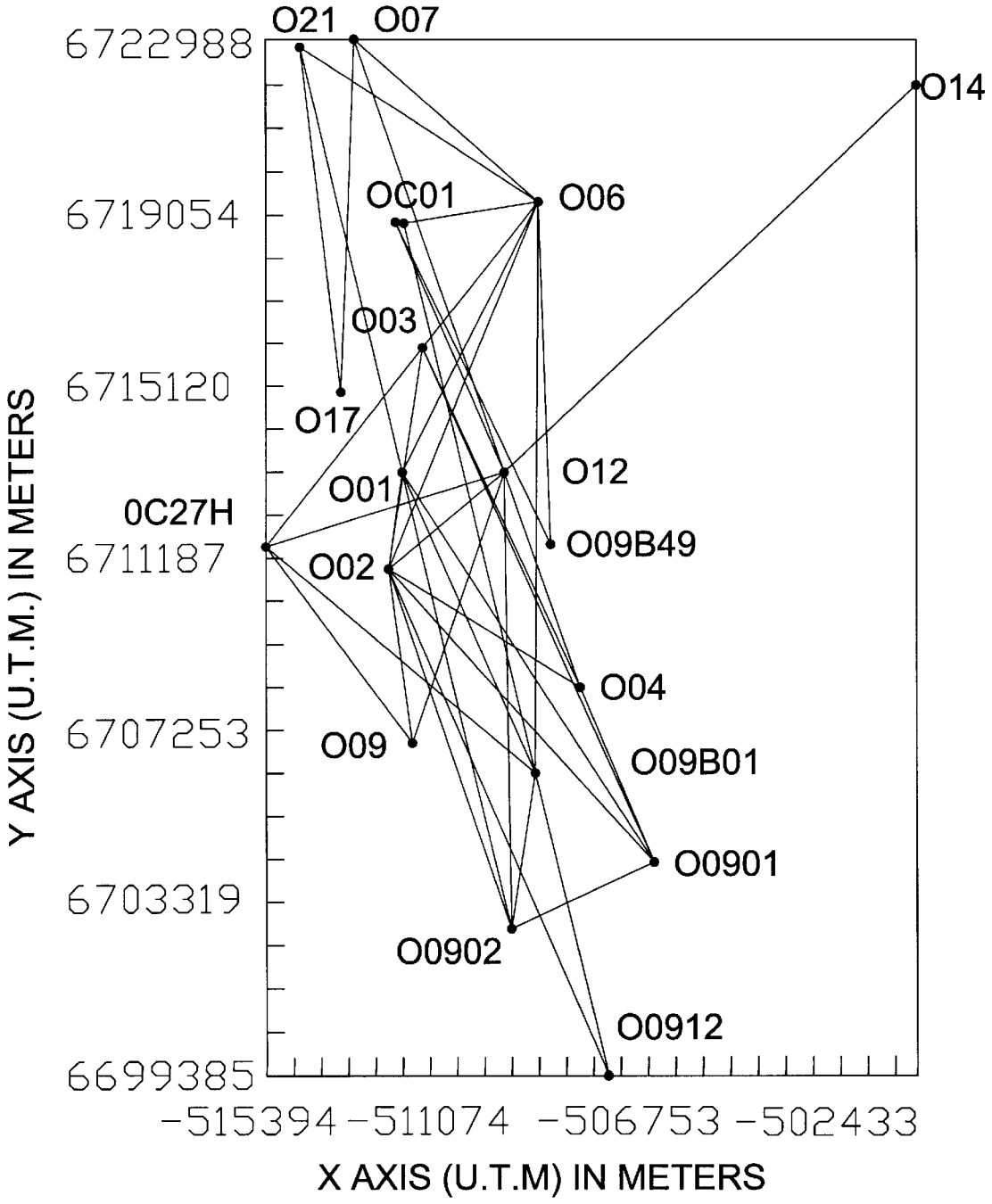
FIG. 8 illustrates a chart showing all the possible three producing well combinations of the field wherein one producing well is the origin well and the compared distance from the origin well to two different wells yields a constant mathematical relationship, and showing all the possible four producing well combinations of the field where the compared distance between one pair of wells to another pair of wells also yields a constant mathematical relationship.

Upon reviewing the ratio data for each distance coupling or pairing for both statistical studies, one utilizing three wells having a common origin well and one utilizing four separate producing wells, reveal that a relatively large number of pairings or couplings produce the same constant ratio. Upon further analysis, each of the producing wells of the field at Oseberg was utilized at least once in the data producing the constant ratio. Every single well of the Oseberg field produced the same constant mathematical relationship at least once when compared to two or three other producing wells of the field. FIG. 8 illustrates each of the twenty-nine couples of distances or distance pairings of the Oseberg field that produced a constant distance ratio of 0.6178 (plus or minus a small statistical variation).

FIG. 9 illustrates a data table including twenty-nine (29) pairs of distances which yield essentially the same constant ratio between the smaller distance Y over the larger distance X of each coupling or pairing. As can be seen in this data table, the couplings 4, 10 and 20 represent the first statistical study and utilize only three producing wells and have a common origin well. The remaining couplings or pairings represent the second statistical study and utilize four separate producing wells in comparing distances for each of the remaining couplings.

Figure 10:
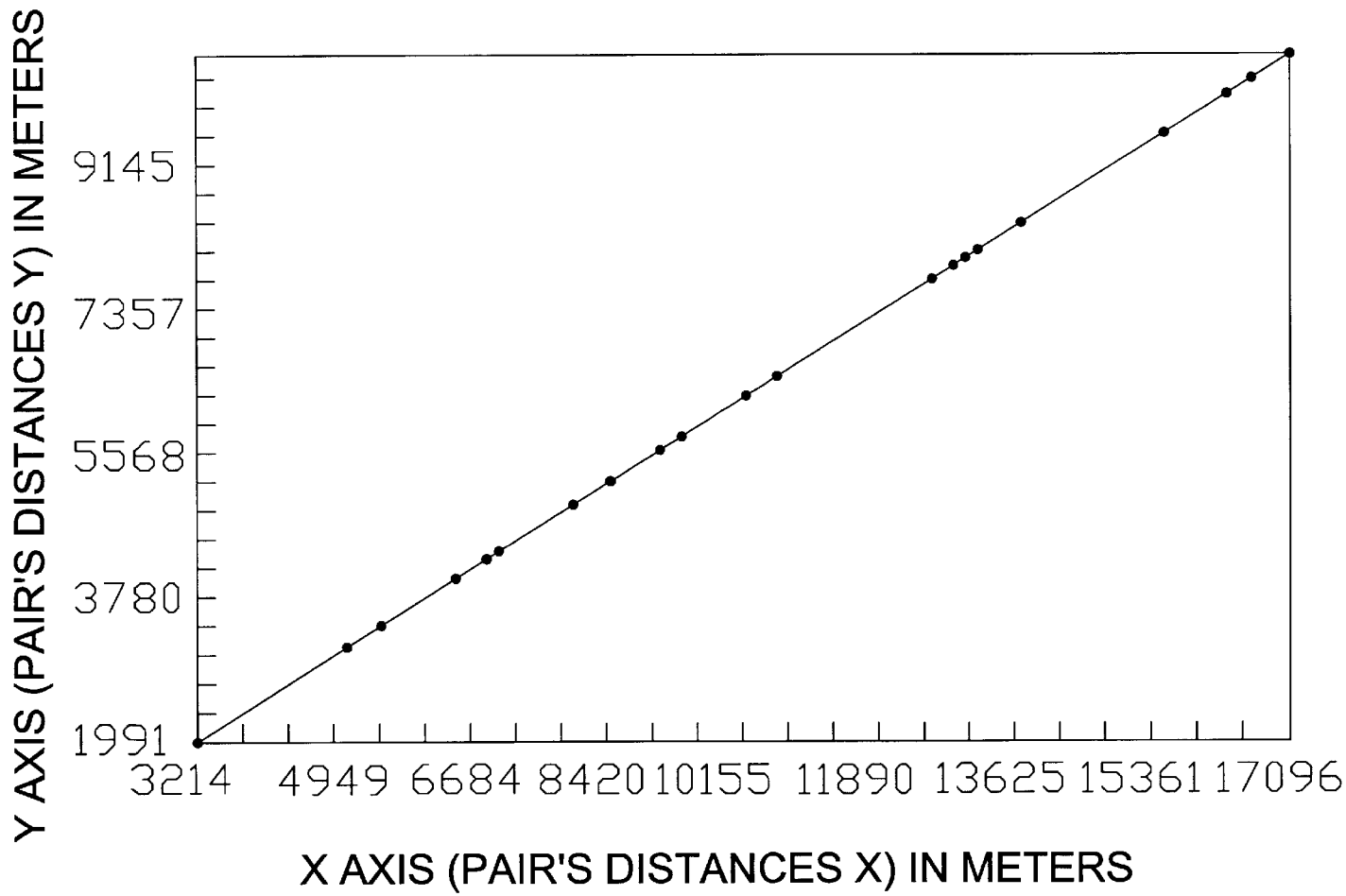
FIG. 10 illustrates a chart representing the mathematical constant produced by the well distance pairings of the data table in FIG. 9.

FIG. 10 illustrates a-chart plotting the ratio of the distance couplings for each coupling or pairing 1 through 29 shown in the data table in FIG. 9. The slope of the curve is linear and was calculated as B=0.6178017. The chart of FIG. 10 plots the larger distance X for each distance coupling along the horizontal axis and the smaller distance Y for each particular coupling along the vertical axis of the chart. This chart does not plot coordinates of the UTM system, but instead plots the distance in meters between producing wells for each pair or coupling indicated in the data table of FIG. 9.

The data table of FIG. 11 illustrates comparative data wherein the independent variable X represent the larger distance between producing wells of each coupling or pairing of distances. The second column of the table indicates the actual smaller distance Y for each pairing. Column 3 of the chart indicates a calculated variable Y' utilizing the average mathematical constant of the data of FIG. 8. The fourth column of the table of FIG. 11 denotes the difference in meters between the actual and the calculated dependent variable Y and Y, respectively, for determining a statistical deviation between the actual and calculated variables.

Figure 12:
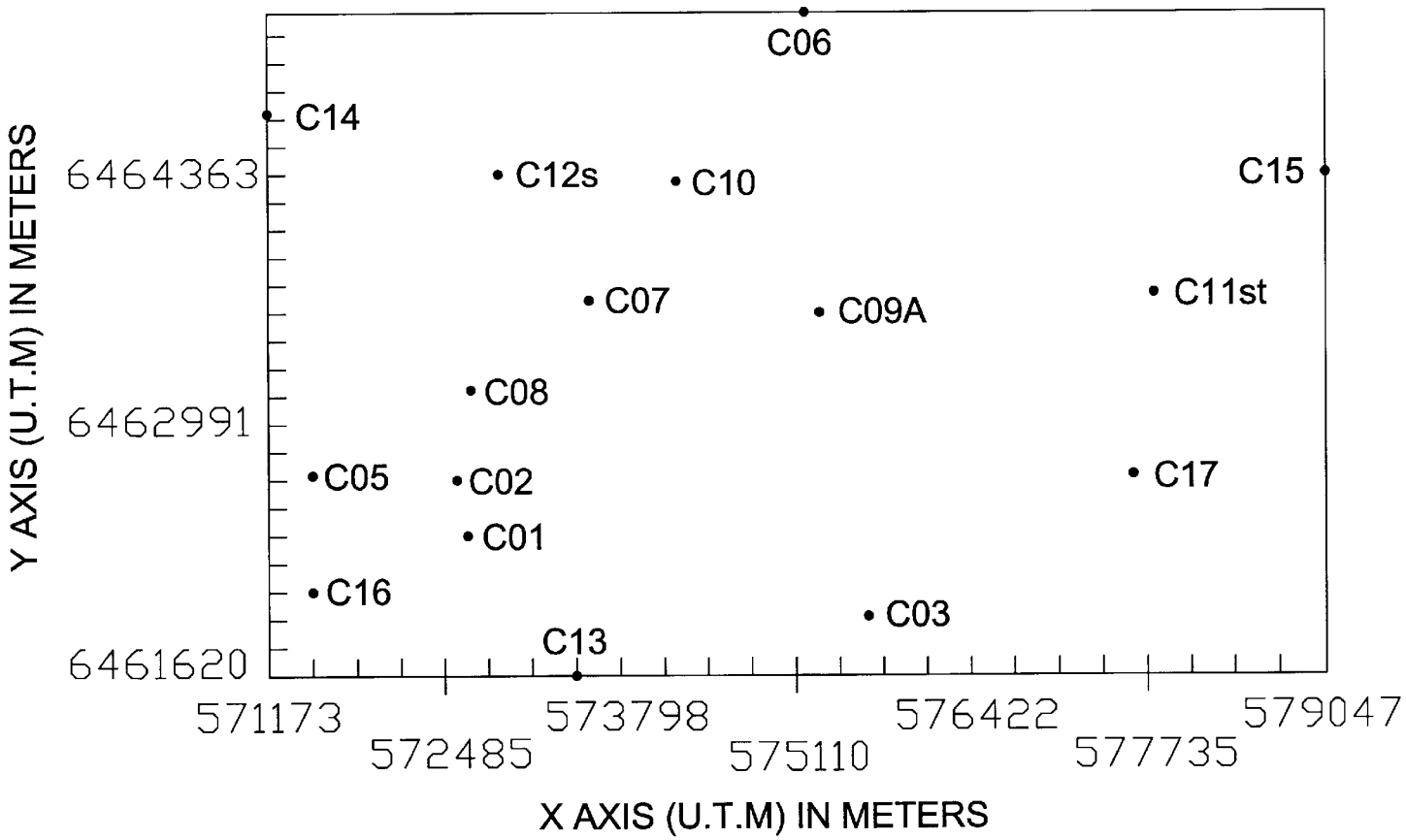
FIG. 12 illustrates a schematic chart representing the producing wells of another oil field located in the United Kingdom.

FIG. 12 illustrates another schematic chart of each of sixteen producing wells in a oil field known as Captain field in the United Kingdom. Again, the geographical coordinates of each producing well are shown in the chart in meters and according to the UTM coordinate system.

Figure 13:
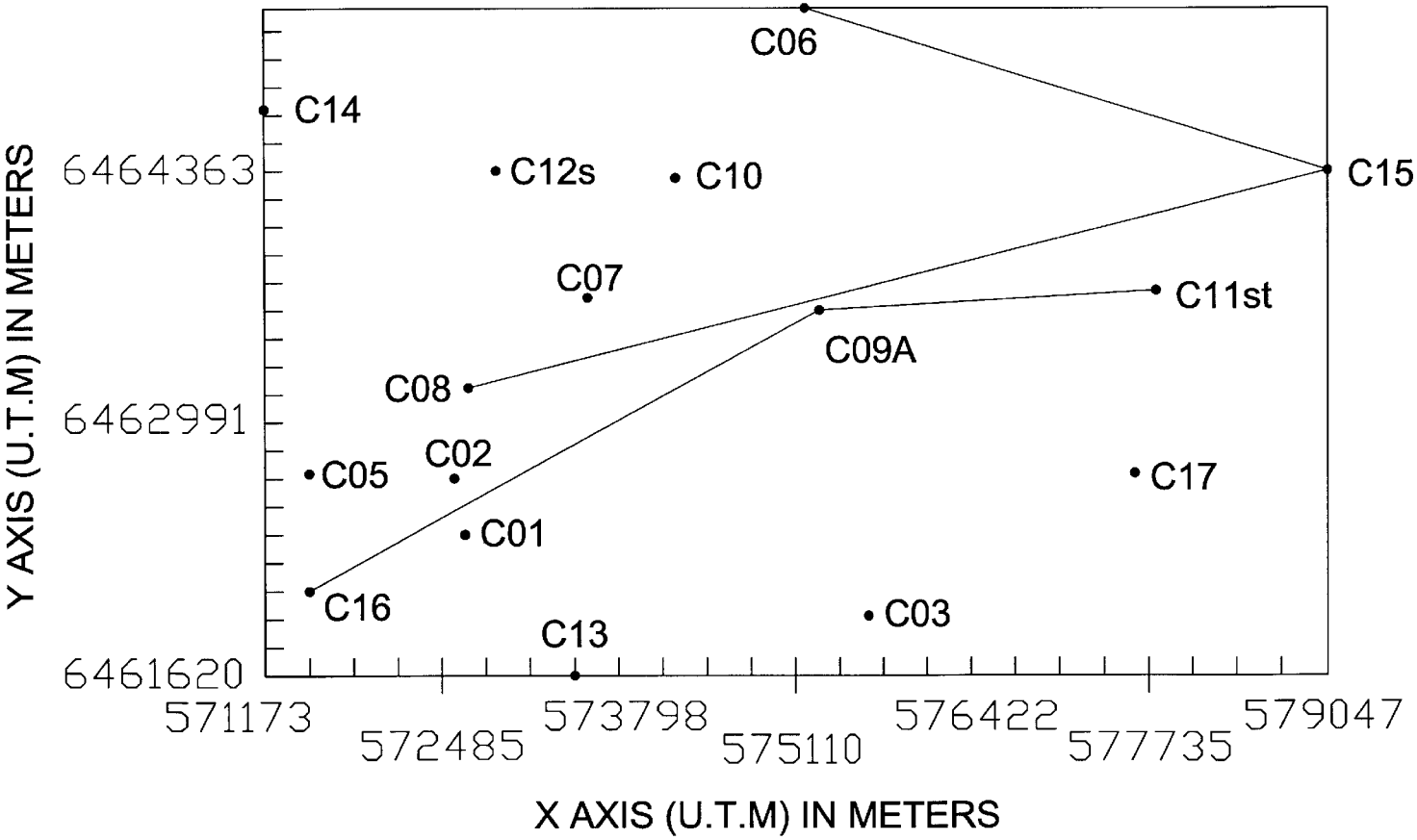
FIG. 13 illustrates the chart of FIG. 12 wherein examples of wells selected as an origin well and the distances from each origin well to two other producing wells are shown.

Similar to that of the Oseberg field discussed above, each possible pair or coupling of distances of producing wells in the Captain field was calculated both utilizing the three well statistically study and utilizing the four well statistical study. FIG. 13 illustrates an example of two different distance pairs or couplings wherein each pair or coupling has a common origin well. For example, the origin well C15 is selected and the distance from C15 to the producing well C06 and the distance from C15 to the producing well C08 makeup the two distances of the pair. As another example, the origin well C09A is selected and the distance between C09A and the producing well C11ST and from C09A to the producing well C16 makeup the two distances of that particular pair.

Figure 14:
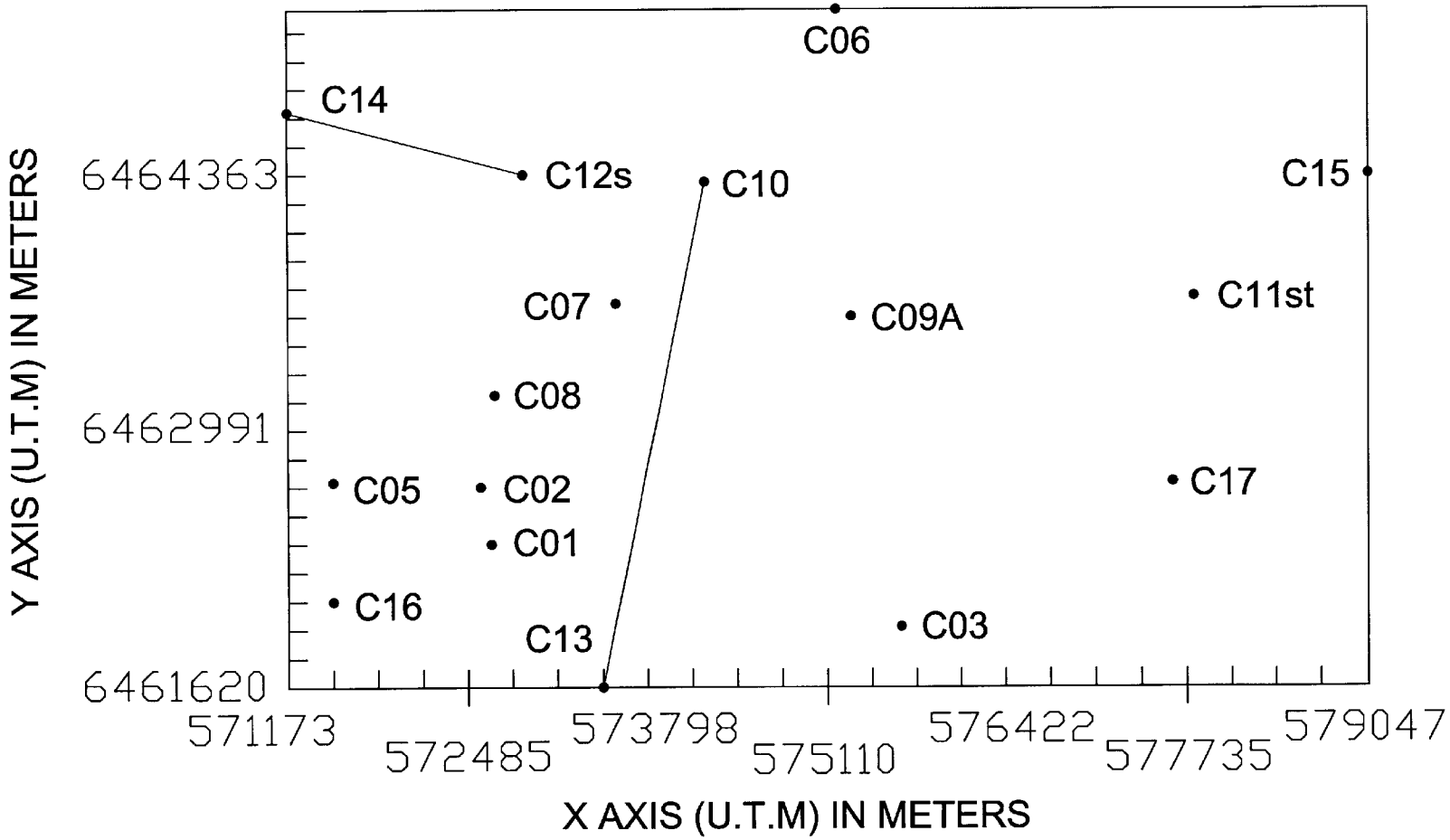
FIG. 14 illustrates the chart of FIG. 12 wherein the distance between first pairs of producing wells are compared to the distances between other second pairs of producing wells.

Similarly, FIG. 14 illustrates one example of a distance coupling or pair wherein the coupling or pair utilizes four separate producing wells. One distance of the pair is from the producing well C14 to C12s and the other distance of the pair is the distance from the well C13 to the well C10.

Of all of the possible distance pairing combinations both utilizing three producing wells having a common origin well and utilizing four separate producing wells, twenty-seven (27) pairings or couplings yielded a common distance ratio of the smaller distance Y of each pairing over the larger distance X of each pairing and which utilized each and every producing well at least once for the entire Captain field. As shown in the table of FIG. 15, of the twenty-seven different couplings that produce the constant ratio, the couplings 1, 11, 12, 16, 18, 21 and 27 utilize three producing wells and a common origin well whereas the remaining couplings utilize four separate producing wells.

Figure 16:
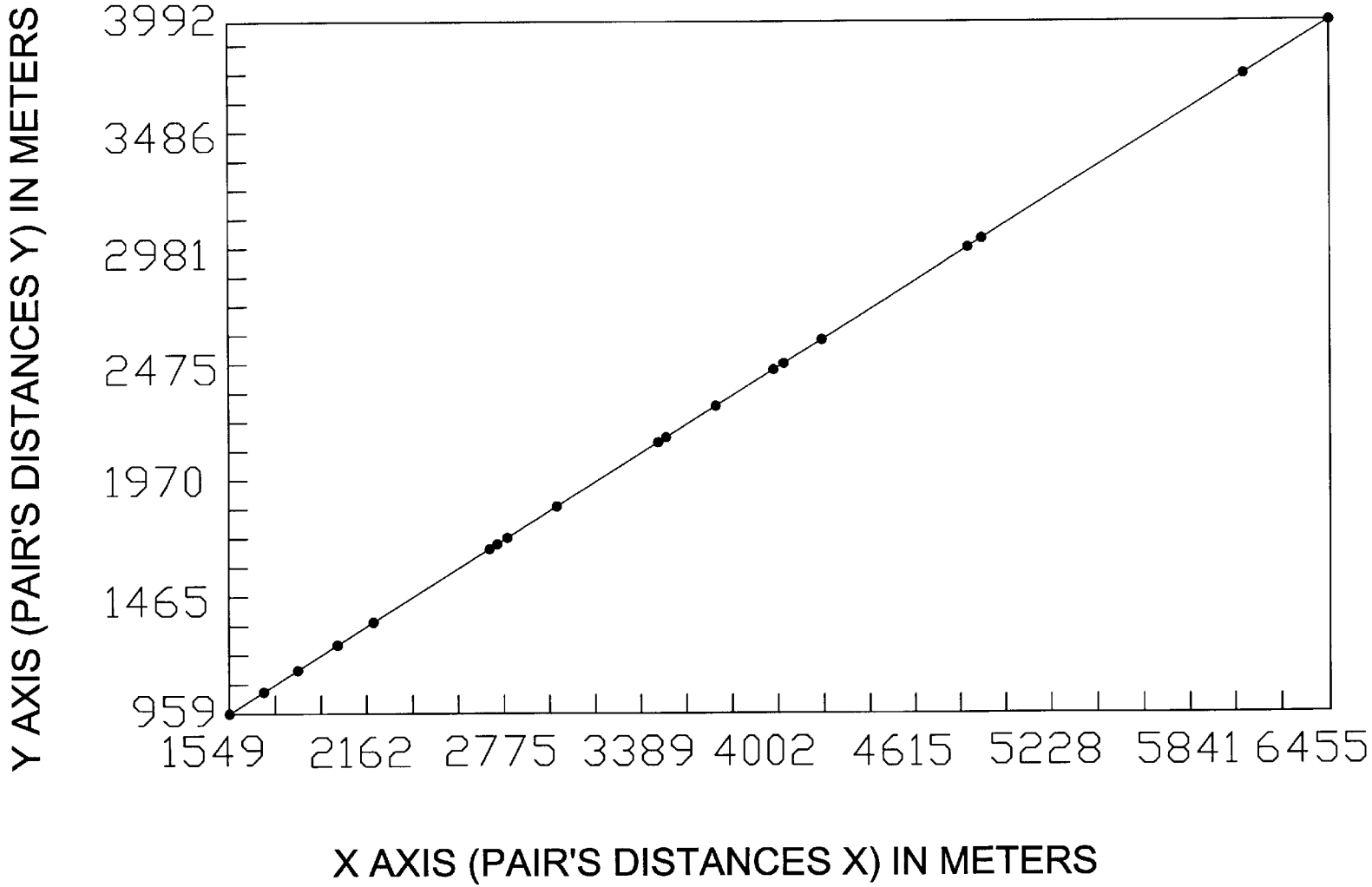
FIG. 16 illustrates a chart denoting the mathematical constant produced by the pairings of wells illustrated in the table of FIG. 15.

FIG. 16 illustrates a chart comparing the larger distance X of each pair along the horizontal axis to the smaller distance Y of each pair along the vertical axis. The slope of the curve is again linear or constant and is B=0.6181176 for the captain field.

FIG. 17 illustrates a data table comparing the actual larger distance X, smaller distance Y, calculated average smaller distance Y', and the difference of Y–Y' for each of the twenty-seven pairs or couplings that produce the constant ratio for the Captain field.

Figure 18:
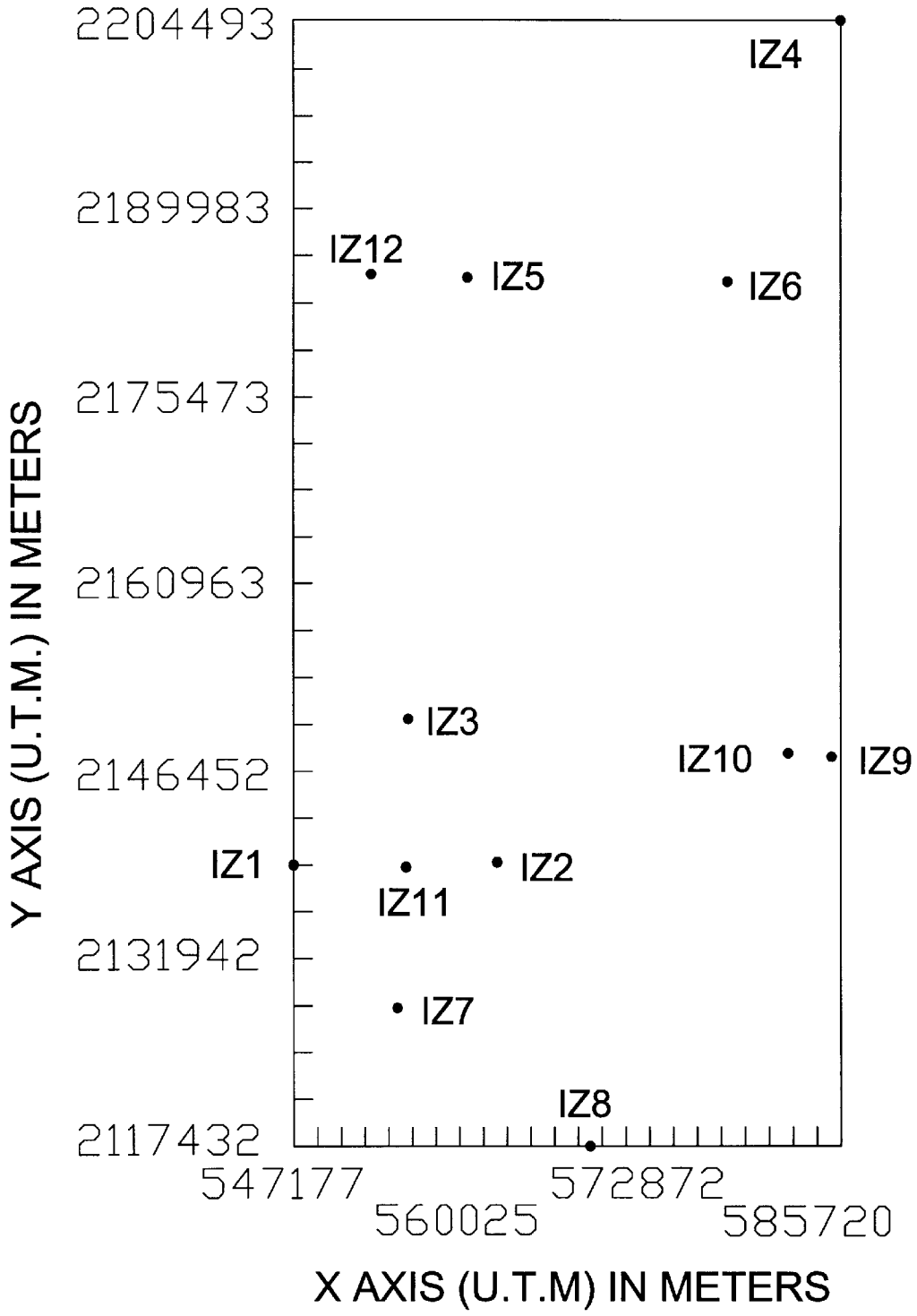
FIG. 18 illustrates a schematic chart showing each of the producing wells of another oil field located in Argentina.

As another example, FIG. 18 illustrates a schematic chart of the twelve oil producing wells of an oil field identified as Izozog Field, located in Argentina. Again, the chart includes units of meters and geographically locates the wells according to the UTM coordinate system.

Figure 19:
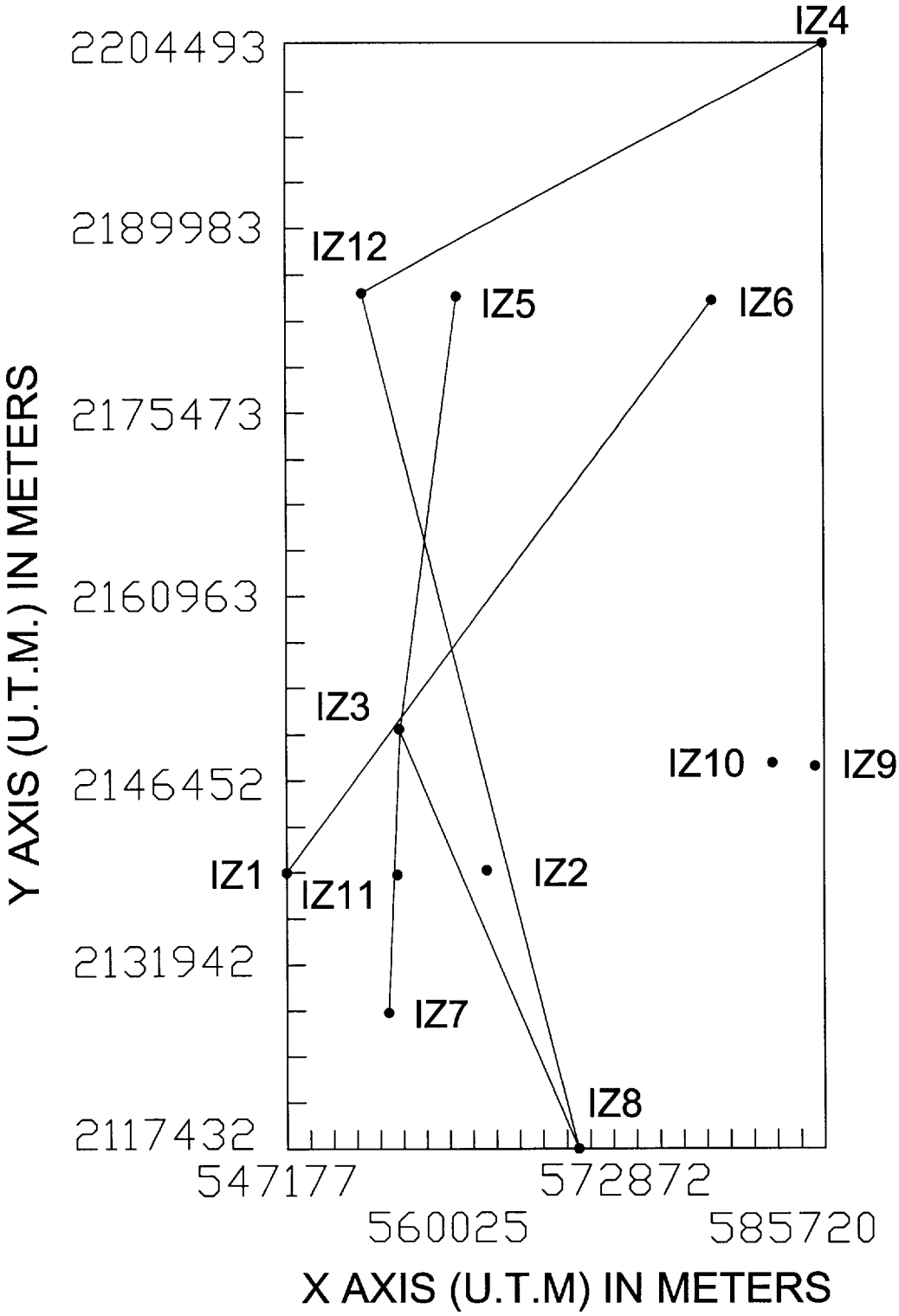
FIG. 19 illustrates a chart showing distances between a number of exemplary producing wells or well pairings.

FIG. 19 illustrates three examples of distance couplings or pairings utilizing only three producing wells with one of the three origin well. For example, where the well IZ12 is the origin well, the distance from the IZ12 to the IZ4 well and the distance from IZ12 to the IZ8 well provide one distance pairing. Where the producing well IZ3 is the origin well, the distance from the IZ3 well to the IZ8 well and the distance from the IZ3 well to the IZ7 well provides another distance pair. Also illustrated in FIG. 19, is one example of a distance pairing utilizing four separate oil producing wells. For example, the large distance X for this pairing is the distance from the well IZ6 to the well IZ1 and the small distance Y is the distance between the IZ5 well and the IZ3 well.

Figure 21:
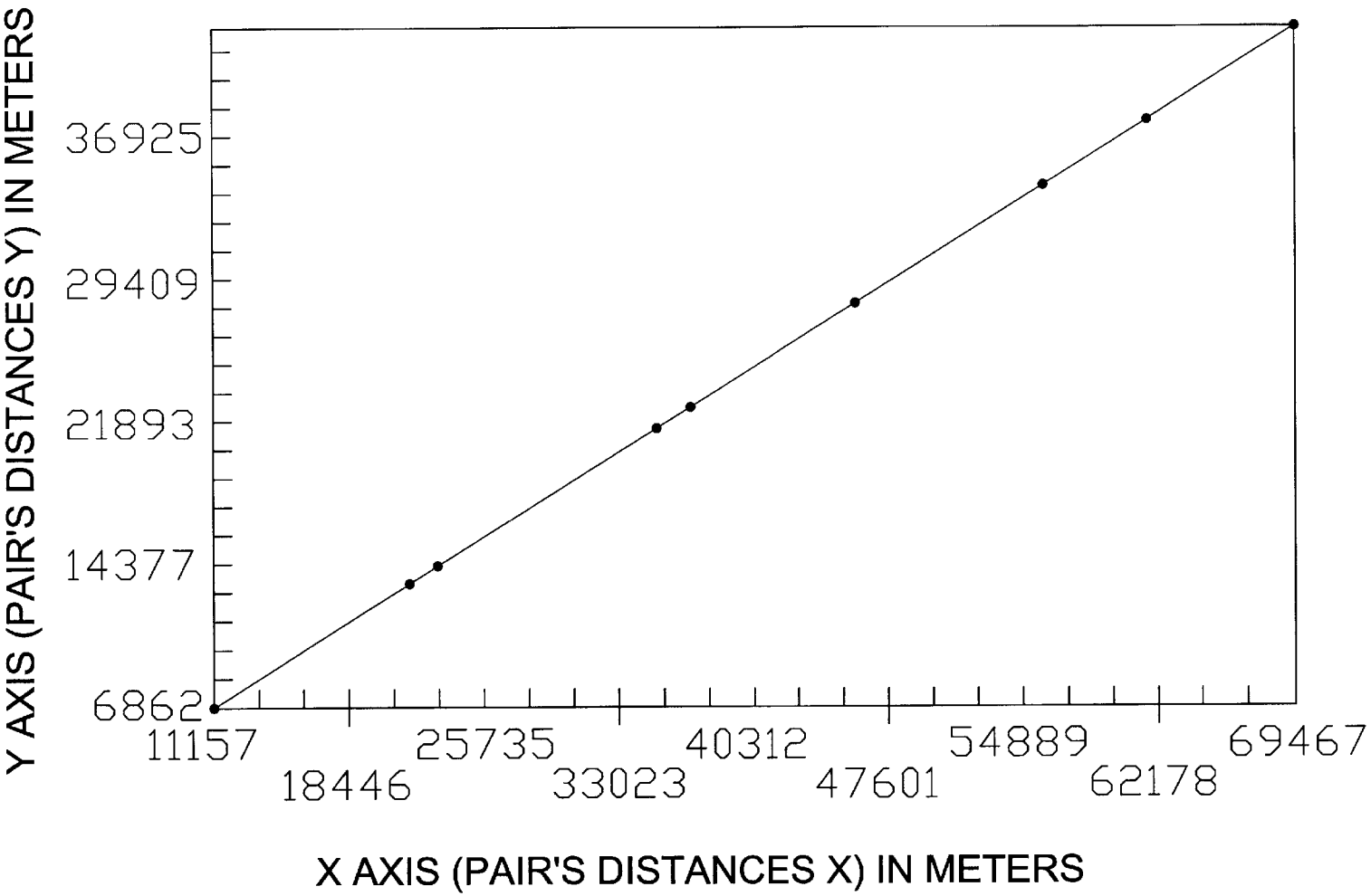
FIG. 21 illustrates a chart denoting the mathematical constant for each of the producing well distance pairings of the table of FIG. 20.

Out of all the possible distance pairings utilizing either the three well or the four well statistical analysis, nine (9) pairings again produced the same constant and also utilized each and every well at least once for the entire Izozog field. The data for each of these nine pairings is shown in the table of FIG. 20. As shown in FIG. 20, pairing numbers 1, 2, 4, 6, 8 and 9 utilize only three wells and the distance pairings 3, 5 and 7 utilize four wells. Again, the ratio for each of these pairings identified as the small distance Y over the large distance X of each pairing equals a constant value B=0.6185382. FIG. 21 illustrates a chart having the large distance X of each pair plotted along the horizontal axis and the small distance Y of each pair plotted along the vertical axis. Again, the curve is linear and has a slope of B=0.6185382. This plot includes each of the well pairings shown in the table of FIG. 20.

FIG. 22 illustrates a data table including the large distance X and the small distance Y for each pairing noted in table 20. This data table also includes the calculated average small distance Y' as well as the difference between the calculated distance Y' and the actual distance Y.

In all, ten different oil fields in a number of different countries were statistically analyzed in the manner discussed above. FIG. 23 illustrates a chart or table listing the country and the oil field in that particular country that was analyzed. FIG. 23 also lists the number of producing wells in each field and the number of distance pairings or couplings producing the same mathematical relationship. FIG. 23 also lists the constant or slope B that was discovered for each of the particular oil fields analyzed. Surprisingly, in each oil field analyzed, a distance ratio among a number of distance pairings between three oil wells including an origin well or four separate oil wells, and wherein every producer well in each field was utilized at least once, the constant or slope B was found to be virtually identical.

The average constant or slope B for all of the data obtained from the ten fields analyzed was B=0.61804. The significance of this constant B or slope obtained from all of these different and unrelated oil fields was further analyzed. Given that the constant or slope B represents a ratio of the smaller distance Y of a distance pairing over the larger distance X of the same distance pairing, if the ratio is equal to 0.61804, this relates to the equation 0.61804=Y÷X, then the smaller distance Y is equal to the larger distance X multiplied by the constant ratio 0.61804.

In solving an algebraic problem of comparing two lines X and Y of different length, and in making the bigger line X equal to one (X=1), the value of the smaller line Y is the dependent variable. Solving this problem results in the equation $X^2=Y(Y+X)$. Making X equal to 1, and in solving this quadratic equation, $Y=(-1)+1^2-4(31)(-1)^2=0.618033$. Surprisingly, this value is identical to the slope or constant B derived from analyzing each of the oil fields. Based upon the statistical data obtained from each of the oil fields and the result of equation 5, a new equation $$Y^2+X\cdot Y-X^2=0 \qquad \text{(EQ.2)}$$

is generated bu substituting the variable X for 1 in the equations 3 and 4 above. Utilizing this equation, and knowing the independent variable X being the distance between two producing oil wells in any given oil field, one can calculate the dependent variable Y which can be utilized in a number of different ways.

One use of the present invention can be performed using two existing well locations to find a third. If two existing producing wells are known and the distance is known between the two producing wells, this distance is the independent variable X, or the large distance in a distance coupling or pair. In one example, one of the two wells is selected as the origin well and Equation 2 is used to calculate a second smaller distance or dependent variable Y. A third producing well will be found on a circle having a radius of the distance Y from the origin well. This calculation can be utilized to locate an existing location of a third producing well or alternatively, can be utilized to locate a third well location where a new well can be drilled that will be a producing well within the existing field.

Another use for the present invention can be performed using three existing well locations to find a fourth. Two existing producing wells are known in a given oil field and where the distance X between these two known wells is known. A third known producing well can be selected regardless of its position relative to the first two producing wells. Equation 2 can then be utilized to calculate a smaller distance or dependent variable Y from the third well to a fourth well location.

This particular calculation can be used for two purposes. First, the calculation can be done to locate an existing location of a fourth producing well relative to the third known producing well. Alternatively, this calculation can be performed to locate a fourth well location to drill a new well a distance from the third known producing well anywhere on a circle having a radius the distance Y from the third well.

Utilizing the methods of the invention, any known existing producing well in a given field can be utilized in conjunction with virtually any other known producing well to either locate an existing producing well without knowing its exact location and without resorting to sophisticated locating technology, or alternatively, can be utilized to locate an area where a new producing well can be drilled within the given oil field.

Though specific embodiments of the present invention are described herein, the invention is not intended to be so limited. Modifications and changes can be made to the described embodiments and yet fall within the scope and spirit of the present invention. The invention is intended to be limited only by the appended claims.

I claim as my invention:

1. A method of relating all producing wells in an existing fossil fuel drilling field, the method comprising:

selecting a first origin well that is known to produce a fossil fuel;

selecting a second well that is known to produce a fossil fuel;

determining a linear distance X between the first origin well and the second well;

calculating a distance Y from the first origin well to a third well location relative to the linear distance X and using the equation, $$Y^2+X\cdot Y-X^2=0; \text{ and}$$

selecting a location of the third well relative to the first origin well and having the distance Y from the first origin well.

2. The method according to claim 1, wherein the fossil fuel is a petroleum oil product.

3. The method according to claim 1, wherein the fossil fuel is a natural gas product.

4. The method according to claim 1, wherein the distance from the first origin well to the second well is determined using Universal Transverse Mercator coordinates.

5. The method according to claim 1, wherein the third well location is a new location for drilling a producing well within the existing drilling field.

6. The method according to claim 1, wherein the third well location is an existing producing well location within the existing drilling field.

7. A method of relating all producing wells in an existing fossil fuel drilling field, the method comprising:

selecting a first well that is known to produce a fossil fuel;

selecting a second well that is known to produce the fossil fuel;

determining a linear origin distance X between the first well and the second well;

selecting a third well known to produce the fossil fuel;

calculating a distance Y from the third well to a fourth well location in comparison to the origin distance X and using the equation, $$Y^2+X\cdot Y-X^2=0; \text{ and}$$

selecting a location of the fourth well relative to the third well and having the distance Y from the third well.

8. The method according to claim 7, wherein the fossil fuel is a petroleum oil product.

9. The method according to claim 7, wherein the fossil fuel is a natural gas product.

10. The method according to claim 7, wherein the distance from the first well to the second well is determined using Universal Transverse Mercator coordinates.

11. The method according to claim 7, wherein the fourth well location is a new location for drilling a producing well within the existing drilling field.

12. The method according to claim 7, wherein the third well location is an existing producing well location within the existing drilling field.

* * * * *

UNITED STATES PATENT AND TRADEMARK OFFICE

CERTIFICATE OF CORRECTION

PATENT NO. : 6,206,099 B1
DATED : March 27, 2001
INVENTOR(S) : Olivera

It is certified that error appears in the above-identified patent and that said Letters Patent is hereby corrected as shown below:

Column 8,
Line 12, delete $Y=(-1)+1^2-4(31)\ (-1)^2= 0.618033$ and insert therefor
$Y=(-1)+1^2-4(1)\ (-1)^2=0.618033$ Signed and Sealed this Twentieth Day of November, 2001

*Attest:*

Nicholas P. Godici

*Attesting Officer*

NICHOLAS P. GODICI
*Acting Director of the United States Patent and Trademark Office*